US006795062B1

(12) United States Patent
Boursier

(10) Patent No.: US 6,795,062 B1
(45) Date of Patent: Sep. 21, 2004

(54) SCREEN DRIVER WITH ANIMATION CIRCUIT

(75) Inventor: Alain Boursier, Le Mans (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/337,846

(22) Filed: Jun. 21, 1999

(30) Foreign Application Priority Data

Jun. 23, 1998 (FR) ..... 98 07915

(51) Int. Cl.[7] ..... G09G 5/00; G09G 3/36; G06F 15/16; G06F 12/02; G06F 12/06

(52) U.S. Cl. ..... 345/204; 345/501; 345/564; 345/572; 345/574; 345/98

(58) Field of Search ..... 345/87, 89, 99–100, 345/204, 501–502, 520, 522, 530, 564, 566, 568, 572–574

(56) References Cited

U.S. PATENT DOCUMENTS 4,706,213 A * 11/1987 Bandai ..... 345/682
5,150,312 A * 9/1992 Beitel et al. ..... 345/418
5,287,452 A * 2/1994 Newman ..... 345/520
5,422,997 A * 6/1995 Nagashima ..... 345/552
5,517,612 A * 5/1996 Dwin et al. ..... 345/502
5,650,955 A 7/1997 Puar et al. ..... 365/51
5,680,151 A * 10/1997 Grimm et al. ..... 345/419
5,706,483 A * 1/1998 Patrick et al. ..... 345/562
5,784,037 A * 7/1998 Inoue ..... 345/87
5,801,720 A * 9/1998 Norrod et al. ..... 345/568
5,838,386 A 11/1998 Kim ..... 348/569
6,091,432 A * 7/2000 Diehl et al. ..... 345/562
6,097,401 A * 8/2000 Owen et al. ..... 345/562

* cited by examiner

*Primary Examiner*—Regina Liang
*Assistant Examiner*—Duc Q Dinh
(74) *Attorney, Agent, or Firm*—Dicran Halajian

(57) ABSTRACT

A screen driver for a liquid crystal display screen includes an internal animation circuit for displacing data on a screen. The animation circuit also process data, such as modifying data between a source address and a destination address of a RAM memory. The RAM memory contains a screen memory and a buffer memory. The internal animation circuit allows relief of an external central microprocessor of equipment having the liquid crystal display screen from corresponding processes. Further, the number of data exchanges between the microprocessor and the screen driver is reduced and thus the power consumption of the equipment caused by the screen animations is also reduced.

11 Claims, 3 Drawing Sheets

SCREEN DRIVER WITH ANIMATION CIRCUIT

FIELD OF THE INVENTION

The invention relates to electronic equipment comprising a microprocessor, a liquid crystal display screen and a screen driver having a screen memory. The invention likewise relates to a screen driver comprising a memory for storing data to be displayed on a liquid crystal display.

The invention notably has applications to portable electronic equipment, for example, telephones.

BACKGROUND OF THE INVENTION

Conventional drivers for a liquid crystal display screen, for example, the driver PCF8549 marketed by Philips Semiconductors, notably comprise a screen memory in which a microprocessor of the equipment writes by an external bus the data to be displayed on the screen. The contents of this memory are to be modified by the microprocessor each time one wishes to modify the data to be displayed.

When screen animations are made (modification and/or displacement of data displayed on the screen, progressive replacement of a screen or of part of a screen, rapid display of a succession of images of a series . . . ), the load of the microprocessor thus increases considerably. Furthermore, the number of exchanges on the external bus linking the microprocessor and the screen driver also increases, which brings about an increase of the energy consumed by the equipment.

The problems of power consumption are particularly important in the field of portable electronics, because one always tries to augment the autonomy of pieces of equipment. Moreover, in the case of portable telephone equipment, the microprocessors have a limited power which does not permit them to manage screen animations during communication.

SUMMARY OF THE INVENTION

It is an object of the invention to remedy these drawbacks, and notably permit of realization of screen animations at lower cost in terms of load of the microprocessor and power consumption.

Therefore, equipment and a screen driver according to the invention and as described in the opening paragraph are characterized in that said microprocessor has means for transmitting commands to said screen driver, said commands indicating a processing (C1, C2, C3, C4) to be applied to data (L, H) stored in a source location (S) of said memory, and said screen driver has processing means (50) for carrying out said processing.

The actual operations of displacement are realized by the screen driver which sets the microprocessor free from the corresponding load. Moreover, the exchanges of data resulting from the screen animation in essence take place inside the integrated circuit of the screen driver. The capacity of an internal link to an integrated circuit is well below that of an external link between integrated circuits. The consumption caused by the screen animation is thus much lower.

According to the invention only the functions related to screen animation have been transferred to the screen driver. This allows to optimize the size of the screen driver integrated circuit. As the price of an integrated circuit is proportional to its surface, this allows to optimize the production cost of the equipment. This advantage is of particular importance in the area of consumer electronics. Finally, optimization of the surface of the integrated circuit is also essential for product miniaturization.

In an advantageous embodiment, the screen driver has a buffer memory. Such a memory is used, for example, by the microprocessor for storing specific data, for example fonts or icons. The display of these fonts or icons is then directly carried out by the screen driver without the intervention of the microprocessor. Advantageously, these fonts or icons are stored in compressed form in the buffer memory, notably when two grey levels are sufficient for defining them (one level for the background of the screen and one level for the font or icon to be displayed).

In an advantageous embodiment, processing means permit of modifying the data that have been read out before they are copied to the destination memory location. By way of example, these processing means make it possible to carry out video inversions, block filling and decompression of data read from the buffer memory.

BRIEF DESCRIPTION OF THE DRAWINGS

These and other aspects of the invention will be apparent from and elucidated with reference to the embodiments described hereinafter.

In the drawings.

DETAILED DESCRIPTION OF THE INVENTION

Figure 1:
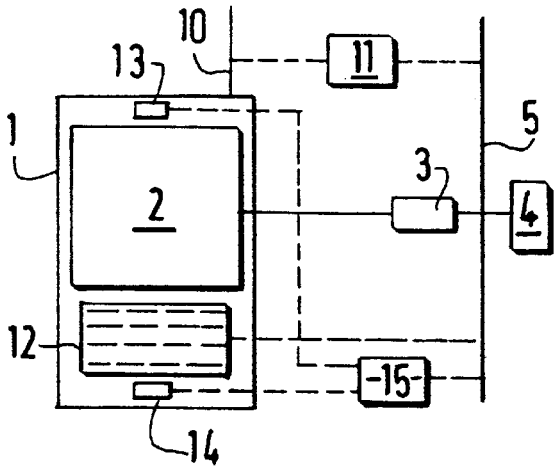
FIG. 1 diagrammatically shows an example of equipment according to the invention.

In FIG. 1 is shown by way of example a diagram of a portable telephone according to the invention. This portable telephone 1 notably comprises a liquid crystal display screen 2 which is connected to a screen driver 3. The screen driver 3 receives commands from a microprocessor assembly 4 to which it is connected by a bus 5. The microprocessor assembly 4 furthermore ensures the conventional operation of the telephone which is represented in symbolic manner in FIG. 1 by dashed links to an antenna 10 via a radio circuit 11, to a keyboard 12, and to an earphone 13 and a microphone 14 via an audio circuit 15.

According to the invention, functions relating to screen display are distributed between the microprocessor 4 of the telephone and its screen driver 3. The microprocessor essentially carries out addressing related processing and it sends commands and addresses relating to the data to be processed to the screen driver 3. The screen driver 3 carries out indicated commands.

Figure 2:
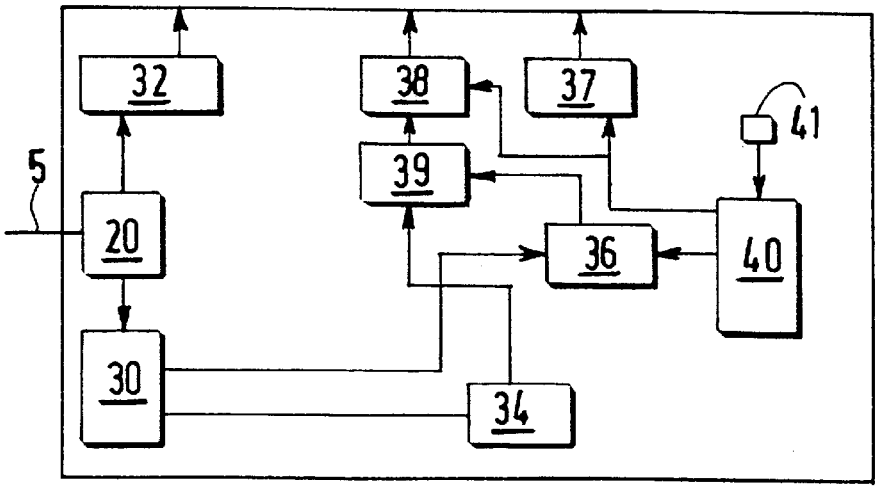
FIG. 2 is a block diagram of a conventional screen driver.

In FIG. 2 is represented an example of a block diagram of a conventional screen driver. This screen driver notably comprises an interface circuit 20 to the bus 5. This interface circuit 20 is connected, on the one hand, to a decoding circuit 30 for decoding received commands and, on the other hand, to a voltage generator 32 which is intended for supplying power to the liquid crystal display screen 2. The circuit 30 manages the access to a screen memory 34 in which are stored the data to be displayed. And it controls a video sequencer 36 which manages the display on the screen via an amplified shift register 37 and an output amplifier 38. The display is made line by line: by order of the video sequencer 36, each line to be displayed is read from the screen memory 34, stored in a latch register 39, then transmitted to the output amplifier 38 which controls the columns of the screen. Similarly; the shift register 37 controls the lines of the screen. The circuits 37 and 38 and the video sequencer 36 receive clock pulses coming from a timing generator circuit 40 which itself is connected to an oscillator 41.

Figure 3:
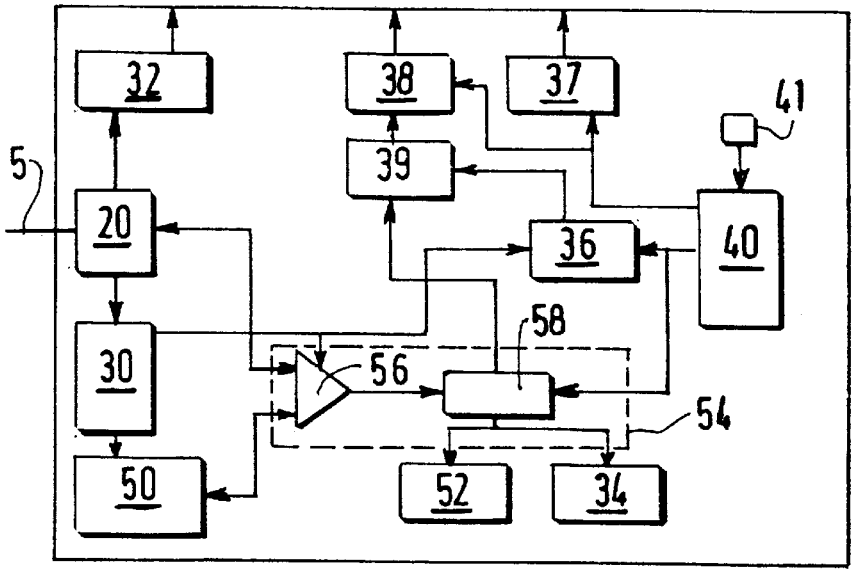
FIG. 3 is a block diagram of a screen driver according to the invention which notably comprises a circuit called animation circuit for modifying and displacing blocks on the screen.

In FIG. 3 is shown a screen driver according to the invention. This screen driver 3 comprises, in addition to the driver of FIG. 2, an animation circuit 50 which modifies and displaces blocks of points on the screen for realizing various animations. This animation circuit 50 receives commands coming from the command decoding circuit 30 and it has access to the screen memory 34 to read the data therefrom which it has to process and write the data to be displayed on the screen after they have been processed. The screen driver 3 according to the invention also includes a buffer memory 52 which is used for storing intermediate data, and an access management device 54 for managing the access to the memories 34 and 52. This access management device 54 includes a multiplexer 56 which is controlled by the command decoding circuit 30 for giving access to the memories either at the microprocessor of the equipment (via bus 5), or at the animation circuit 50. It also includes a double access circuit 58 which manages the interface between the multiplexer 56 or the register 39, on the one hand, and the two memories 34 and 52, on the other hand. This double access circuit also receives clock pulses coming from the timing generator circuit 40 for controlling the writing operations in the register 39.

Figure 4:
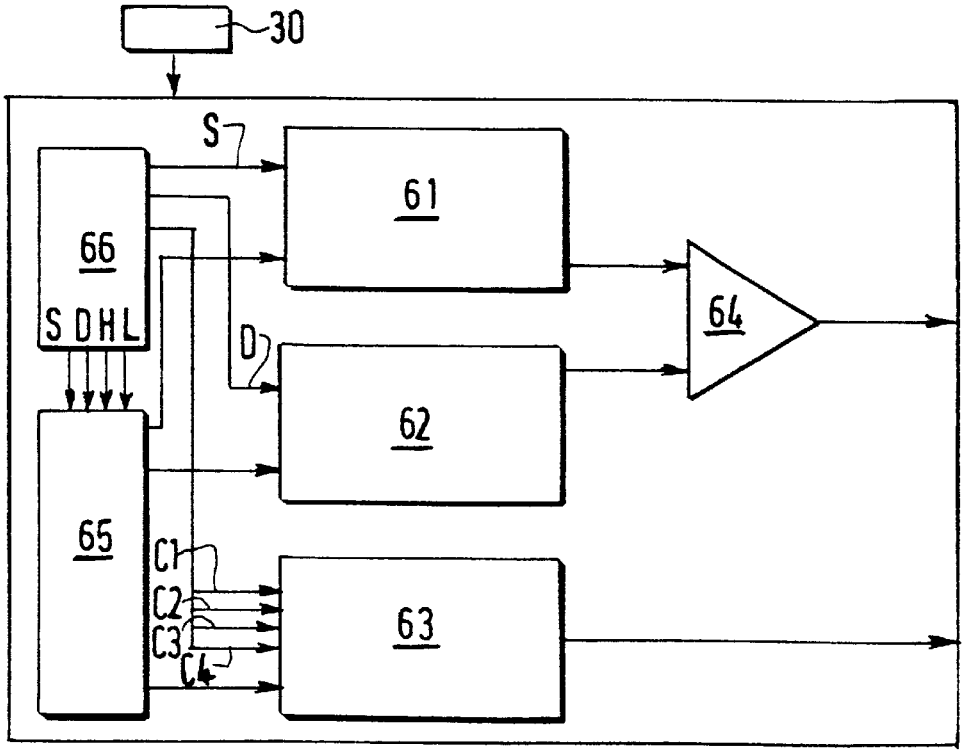
FIG. 4 is a block diagram of the animation circuit of FIG. 3, and FIGS. 5 and 6 are more detailed diagrams of certain blocks of the animation circuit of FIG. 4.

In FIG. 4 is shown a block diagram of an animation circuit 50. In a general manner, this circuit permits of performing various ways of copying a points block (an icon or a character, for example) from a source memory location to a destination memory location.

The animation circuit 50 comprises a source address generator circuit 61, a destination address generator circuit 62, a data processing circuit 63 which reads and writes the data from and into the screen memory 34 or the buffer memory 52, a multiplexer 64 which permits of addressing these two memories 34 and 52 based on an address generated either by the source address generator 61 or by the destination address generator 62, and a sequencer 65 which controls the operation of the circuits 61 and 62 for generating the address and the circuit 63 for processing the data.

The parameters which are applied to the animation circuit 50 by the microprocessor of the equipment are the following:

S: first source address (that is to say, source address of the first point of the block to be processed), D: first destination address (that is to say, the destination address of the first point of the block to be processed), L: width of the block to be processed, H: height of the block to be processed, C1, C2, C3 and C4: selection commands of the mode of operation of the processing circuit 63 (in the following it will be seen that the circuit 63 has various modes of operation).

These parameters are stored in registers 66 to be used by the circuits 61, 62, 63 and 65 of the animation circuit 50.

The source and destination address generators 61 and 62 have for their function to successively generate all the memory addresses (source and destination respectively) that correspond to the block to be processed, based on the first source address and the first destination address, respectively.

In practice, the buffer memory and the screen memory correspond to two different areas of a RAM memory, called buffer area and screen area in the following of the description. These two areas are organized differently. The buffer area is an area called adjacent area in which the data are stored in adjacent manner, that is to say, the data lines forming a block are stored after another. In contrast, the screen area is a fragmented area which is a representation of the screen. This means that the various lines of the block are not stored one after the other, but at the memory address that corresponds to their position on the screen. For passing from one line to the another, it is thus sufficient to increment the memory address by unity when the block is read from an adjacent memory. When it is read from a segmented memory, the number of memory locations necessary for storing a whole line has to be added to the address of the beginning of the line. For example, when the RAM memory contains words of 8 bits, when each point of the screen is coded into 2 bits (which permits of having 4 grey levels), and when the lines of the screen contain 104 points, 26 memory locations are necessary for storing the screen line. With the segmented area, 26 is thus to be added to a line start address for going over to the next line start address in the same block.

Figure 5:
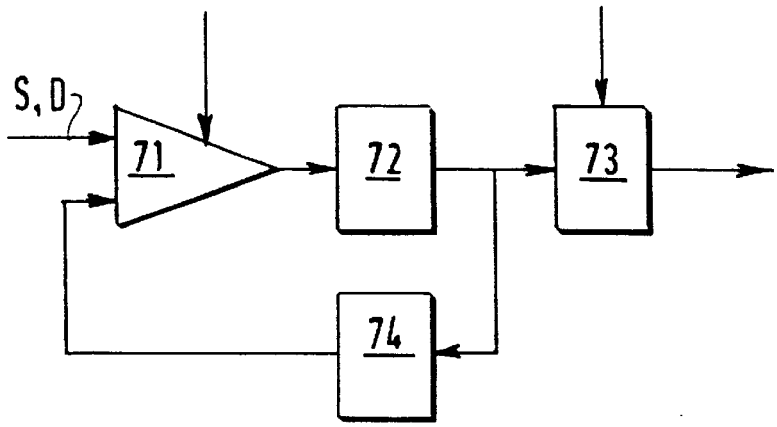

In FIG. 5 is represented a block diagram of such an address generation circuit. It comprises a multiplexer circuit 71 which is controlled by the sequencer 65, a register 72 for storing the current address of the line start, an address counter 73 which is also controlled by the sequencer 65, and an adder 74. The multiplexer 71 has a first input which receives the first source address S or destination address D stored in the registers 66, and a second input which receives the address delivered by the adder 74.

The sequencer first of all sends an order to the multiplexer 71 so that the first source address S or destination address D is copied in the register 72. Ordered by the sequencer 65, the address stored in the register 72 is read by the address counter 73 which is incremented by unity. The incremented address is then delivered on the output of the address generator. The adder 74 adds to the address read from the register 72 the value necessary for passing to the next line of the block to be processed when the processed block is stored or is to be stored in the segmented memory.

When, after each incrementation, the whole line has been passed through and when the processed block is or is to be stored in the segmented memory, the sequencer sends an order to the multiplexer 71, so that the address produced by the adder 74 is stored in the register 72. The operation is then effected line after line until the end of the block.

When the processed block is stored or is to be stored in the adjacent memory, the address counter 73 continues to increment until the last address of the block is reached.

The instants at which the sequencer 65 sends its orders to the multiplexer 71 and to the address counter 73 depend on the width L and the height H of the block to be processed and on the adjacent or segmented type of the source or destination memory area. The sequencer 65 reads the parameters L, H, S and D from the registers 66.

Figure 6:
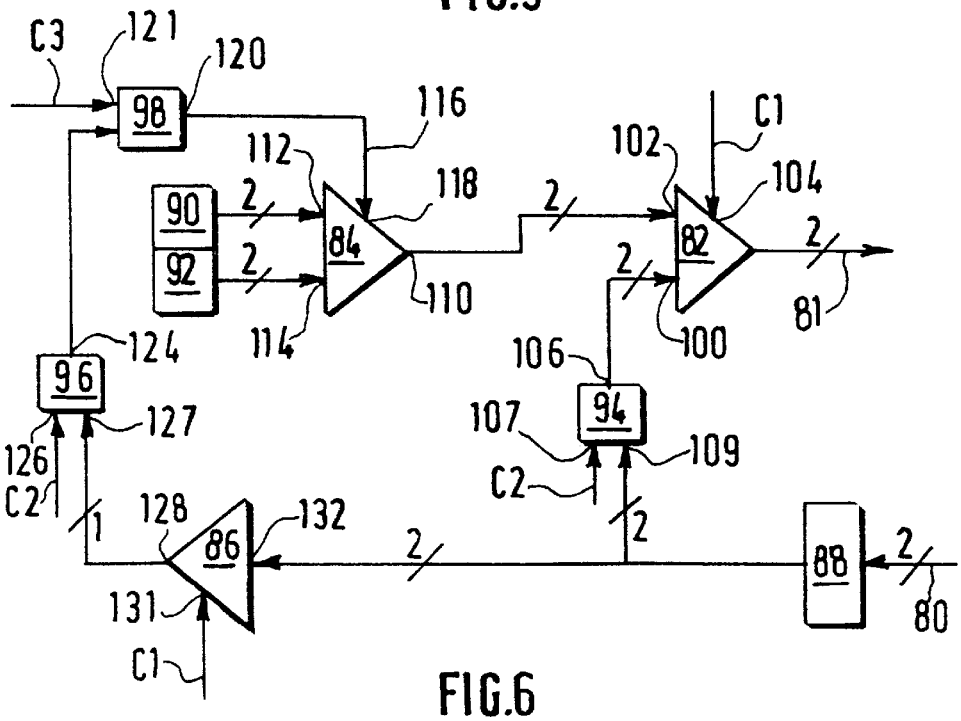

In FIG. 6 is represented an example of a data processing circuit 63 which permits of carrying out various processings of the data 80 read from the address memory indicated by the source address generator as a function of the received commands C1, C2, C3 and C4. The data 81 produced on the output of the circuit 63 are copied to the memory at the address indicated by the destination address generator. In the embodiment described here, the various possible processings are the following:

- a simple copy in which the output data 81 are identical with the input data 80, video inversion which consists of complementing the data 80 received on the input,
- the filling of the block,
- the conversion of a 1-bit screen point coding to a 2-bits coding with possibly video inversion.

For this purpose, the circuit 63 includes three multiplexers 82, 84, 86, one register 88 intended for storing the input data 80, two programmable registers 90 and 92 for storing two grey levels coded in 2 bits each, two logic gates 94 and 96 which perform the exclusive-OR function, one logic gate 98 which performs the logic AND function.

The multiplexer 82 delivers the output data 81. These data are formed by the data present either on a first input 100, or on a second input 102 of the multiplexer 82, depending on whether the level is high or low respectively, of a control signal C1 carried on a third input 104 of the multiplexer 82.

The first input 100 is formed by an output 106 of the gate 94 (exclusive-OR). This gate 94 has a first input 107 which receives a control signal C2 and a second input 109 which receives the input data 80 stored in the register 88. The command C2 indicates whether the inverse video function is active. In that case (high level of the signal C2), the data available on the input 100 of the multiplexer 82 correspond to the logic complement of the input data. In the opposite case (low level of the signal C2), they are identical with the input data.

The second input 102 of the multiplexer 82 is connected to an output 110 of the multiplexer 84. This output 110 copies the data present on a first input 112 or on a second input 114 of the multiplexer 84, depending on whether there is a high or low level respectively of a control signal 116 carried by the third input 118 of the multiplexer 84. The first and second input 112 and 114 of the multiplexer 84 are connected to the output of the registers 90 and 92, respectively.

The third input 118 of the multiplexer 84 is connected to an output 120 of the gate 98 (AND gate). The gate 98 has a first input 121 which receives a control signal C3, and a second input which is connected to an output 124 of the gate 96 (exclusive-OR). The gate 96 itself has a first input 126 which receives the control signal C2, and a second input 127 which is connected to an output 128 of the multiplexer 86. The multiplexer 86 is controlled by a control signal C4 which is applied to its first input 131. It copies on its output 128 one of the two bits applied to its input 132 depending on whether the control signal C4 is high or low. The input 32 is connected to the output of the register 88.

When the control signal C1 is high, the mode of operation "simple copy without data inversion" (low control signal C2) is selected, or "simple copy with data inversion" (high control signal C2).

The control signals C3 and C4 are used in the following manner. When the signal C3 is low, the circuit operates in the filling mode: the output of the gate 98 (AND gate) is low, so that the multiplexer 84 produces on the output the color called background color (for example 00 or 01) stored in the programmable register 92. If the control signal C1 is low, the data 81 delivered on the output are equal to the contents of the register 92 whatever the data 80 applied to the input are. Thus the block is filled with the background color stored in the register 92.

If the control signal C3 is high, the circuit operates in the coding format conversion mode. This mode of operation has two steps. The first step takes place when the control signal C4 is low and it consists of copying to the output of the multiplexer 86 the first one of the two bits read from the register 88. This bit is copied (after inversion if the control signal C2 indicates that one is in the inversion mode) to the third input of the multiplexer 84. If this is a zero bit, it is the background color contained in the register 92 (for example 00 or 01) that is copied to the output of the multiplexer 84. If this is a 1-bit, it is the color called font or icon color (for example 10 or 11) contained in the programmable register 90 that is copied on the output of the multiplexer 84. If the control signal C1 is low, the 2 bits thus obtained are delivered on the output of the circuit 63. A format conversion has thus taken place based on the first bit contained in the register 88. The second step takes place when the control signal C4 is high and it consists of copying on the output of the multiplexer 86 the second one of the 2 bits read from the register 88. This step which is identical with the preceding step carries out a format conversion based on the second bit contained in the register 88.

The controls to be applied to the circuit 63 as a function of the mode of operation sought are resumed hereinbelow (x indicates that the state of the control is indifferent for the function considered):

| | C3 | C1 | C2 | C4 |
|---|---|---|---|---|
| simple copy with inversion | x | 1 | 1 | x |
| simple copy with inversion | x | 1 | 0 | x |
| conversion of coding format with inversion: | | | | |
| 1st step | 1 | 0 | 1 | 0 |
| 2nd step | 1 | 0 | 1 | 1 |
| conversion of coding format without inversion: | | | | |
| 1st step | 1 | 0 | 0 | 0 |
| 2nd step | 1 | 0 | 0 | 1 |
| filling | 0 | 0 | x | x |

It will be noted that the function "conversion of coding format" makes it possible for the microprocessor to store data in the buffer memory under a format of 1 bit per pixel so as to save place. For example, there may be fonts of characters or icons whose points have all the same grey level. To be displayed on the screen, such data are to be copied in the screen memory with a format of 2 bits per pixel.

By way of example, the microprocessor may store in the buffer memory a series of positions of the second hand. A screen animation may thus consist of successively displaying every second a dial of the series to give the impression that the second hand moves. In that case, it is clearly advantageous to store the series of dials in the buffer memory in compressed form. For displaying said screen, the controller is thus to read the corresponding icons (coded by 1 bit per pixel) from the buffer memory, decompress them and write the resulting data (coded in 2 bits per pixel) in the screen memory.

The invention is not only restricted to the embodiment that has just been described by way of example.

More particularly, the embodiment described does not permit of dissociating the four points of the screen whose code is stored in the same location of the RAM memory. But in another embodiment it would be possible to realize this at the cost of an enhanced complexity of the animation circuit.

Furthermore, other modes of operation or different modes of operation may be provided for the processing circuit 63.

What is claimed is:

1. Electronic equipment, comprising:

a microprocessor, a liquid crystal display screen, and a screen driver having a memory, a source address generator and a destination address generator; wherein:

said microprocessor has means for transmitting a command to said screen driver, said command indicating a processing to be applied to a block of data stored in a source location of said memory, a first source address, and a first destination address;

the source address generator generates addresses for reading the block of data from the source location of the memory based on the first source address;

the destination address generator generates addresses for storing the block of data to a destination location of the memory based on the first destination address; and said screen driver has processing means for carrying out said processing, wherein said processing means include a data processing generator, said data processing generator being configured to carry out said command and process said block of data for display on said display screen without intervention of said microprocessor so that a load of said microprocessor is reduced.

2. Equipment as claimed in claim 1, wherein said memory has a screen area for storing data to be displayed on said screen and a buffer area for storing intermediate data or specific data.

3. Equipment as claimed in claim 1, wherein said processing means have format conversion means for converting the format of the block of data read from said source location.

4. Equipment as claimed in claim 1, wherein said processing means comprise video inversion means for inverting the block of data read from said source location.

5. A screen driver, comprising:

a memory for storing data to be displayed on a liquid crystal display screen, data processing means for carrying out a command received from an external processor, said command indicating a processing to be applied to a block of data stored in a source location of said memory, a first source address, and a first destination address;

a source address generator; and a destination address generator; wherein:

the source address generator generates addresses for reading the block of data from the source location of the memory based on the first source address;

the destination address generator generates addresses for storing the block of data to a destination location of the memory based on the first destination address; and said data processing means include a data processing generator, said data processing generator being configured to carry out said command and process said block of data for display on said display screen without intervention of said microprocessor so that a load of said microprocessor is reduced.

6. A screen driver as claimed in claim 5, wherein said memory has a screen area for storing data to be displayed on said screen and a buffer area for storing intermediate data or specific data.

7. A screen driver as claimed in claim 5, wherein said processing means comprise video inversion means for inverting the block of data read from said source location.

8. An electronic device comprising:

a device processor;

a screen; and a screen driver having a screen memory, a screen processors, a source address generator and a destination address generator;

wherein said device processor is external to said screen driver and provides a command to said screen processor of said screen driver, said command indicating a processing to be applied to a block of data stored in said screen memory, a first source address, and a first destination address;

the source address generator generates addresses for reading the block of data from a source location of the screen memory based on the first source address;

the destination address generator generates addresses for storing the block of data to a destination location of the screen memory based on the first destination address;

said screen processor including a data processing generator which is configured to carry out said command and process said block of data for display on said screen without intervention of said device processor so that a load of said device processor is reduced.

9. Equipment as claimed in claim 1, wherein:

the data block has a width and height indicated by the command.

10. A screen driver as claimed in claim 5, wherein:

the data block has a width and height indicated by the command.

11. The electronic device of claim 8, wherein:

the data block has a width and height indicated by the command.

* * * * *